United States Patent [19]

Scruggs, Jr.

[11] Patent Number: 4,723,587

[45] Date of Patent: Feb. 9, 1988

[54] EXPANSIBLE GATE PROTECTOR

[75] Inventor: Julian C. Scruggs, Jr., Nashville, Tenn.

[73] Assignee: Madison Mill, Inc., Nashville, Tenn.

[21] Appl. No.: 839,190

[22] Filed: Mar. 13, 1986

[51] Int. Cl.[4] ..... E06B 3/92

[52] U.S. Cl. ..... 160/136; 160/164

[58] Field of Search ..... 160/137–143, 160/160–165

[56] References Cited

U.S. PATENT DOCUMENTS

| | | | |
|---|---|---|---|
| 1,511,963 | 10/1924 | Haugh | 160/160 |
| 1,618,328 | 2/1977 | Eberle | 160/160 |
| 2,990,880 | 7/1961 | Catalano et al. | 160/162 |
| 4,669,521 | 6/1987 | Barnes et al. | 160/136 |

FOREIGN PATENT DOCUMENTS

| | | | |
|---|---|---|---|
| 2643 | of 1879 | United Kingdom | 160/164 |

*Primary Examiner*—Ramon S. Britts
*Assistant Examiner*—Blair M. Johnson
*Attorney, Agent, or Firm*—Harrington A. Lackey

[57] ABSTRACT

An expansible baby gate having a main lazy-tong barrier formed of intersecting and pivotally connected first and second main slats which form V-shaped openings between the slats along the top edge portion of the barrier. A supplementary upper barrier, including a plurality of shorter auxiliary slats pivotally connected to each other and to the main slats for occluding the V-shaped openings in the top edge portion of the main barrier.

7 Claims, 4 Drawing Figures

EXPANSIBLE GATE PROTECTOR

BACKGROUND OF THE INVENTION

This invention relates to an expansible gate, and more particularly to a lazy-tong baby gate having an auxiliary barrier for occluding the openings between the slats in the upper edge portion of the gate.

Lazy-tong gates are wll known in the art, as illustrated in the following U.S. Patents:

| | | |
|---|---|---|
| 60,678 | Bresee | Jan. 1, 1867 |
| 67,143 | C. S. Snead | Jul. 23, 1867 |
| 138,527 | J. B. Powell | May 6, 1873 |
| 508,750 | E. Pickett | Nov. 14, 1893 |
| 589,503 | B. Hummers | Sept. 7, 1897 |
| 675,399 | A. E. McCormack | Jun. 4, 1901 |
| 936,812 | W. E. Robinson | Oct. 12, 1909 |
| 2,859,811 | W. H. Rusch | Nov. 11, 1958 |
| 3,074,475 | L. A. McPhaden | Jan. 22, 1963 |
| 3,182,351 | S. R. Kaufman, et al | May 11, 1965 |
| 4,523,745 | Killman, et al | Jun. 18, 1985 |

U.S. Pat. No. 138,527 to Powell, discloses a gate for a railway crossing having vertical rods F and H, and toggle levers J for obstructing the space between the lower portion of the gate and the ground when the gate is expanded in a closed position only.

U.S. Pat. No. 508,750 to Pickett, discloses a folding gate having auxiliary inclined bars I pivotally mounted on top of a gate which has lazy-tong bars pivotally mounted for movement in substantially horizontal planes.

U.S. Pat. No. 4,523,745 to Killman, et al, discloses pocket-shaped shells 10 and an elongated pad 30 fitting over the top vertices of the pivoted gate slats to prevent children from being injured by the tops of the gate slats.

Lazy-tong type baby gates now on the market usually contain a minimum number of pivotally connected intersecting slats. Accordingly, large diamond-shaped openings are formed between the slats, particularly when the gate is expanded in a closed position. Furthermore, large V-shaped openings are formed between the slats in the top and bottom edges of the gate. These openings are of such size that a small child can insert his head into one of the openings and become entrapped or injured. The Federal Consumer Products Safety Commission has become increasingly concerned about the hazard of such conventional baby gates and particularly the large openings between the slats.

SUMMARY OF THE INVENTION

It is therefore an object of this invention to provide a safer expansible lazy-tong baby gate.

An increased number of slats are utilized in the baby gate made in accordance with this invention, in order to substantially reduce the size of the diamond-shaped openings between the slats in the main barrier. The main lazy-tong barrier, with its increased number of slats, is suspended low between the end posts, so that there is little space between the lower edges of the main barrier and the floor when the gate is mounted in a doorway. Moreover, the expansion of the main barrier is limited to prevent the bottom edges of the barrier from rising too high above the floor.

Furthermore, a supplementary or auxiliary upper barrier of a lazy-tong type is mounted on the upper edge portion of the main barrier to form pivotally joined pairs of auxiliary slats which project upward into and occlude the V-shaped openings in the top edge portion of the main barrier. These auxiliary slats are pivotally joined to each other at their upper edges, so that they converge upward over the V-shaped openings. Moreover, the pairs of upward converging auxiliary slats are pivotally joined to each other and to the slats of the upper portion of the main barrier, so that the main barrier and the supplementary upper barrier expand and contract simultaneously and as a unit.

Baby gates made in accordance with this invention now conform to the suggested standards of the Federal Consumer Products Safety Commission.

DESCRIPTION OF THE PREFERRED EMBODIMENT

Figure 1:
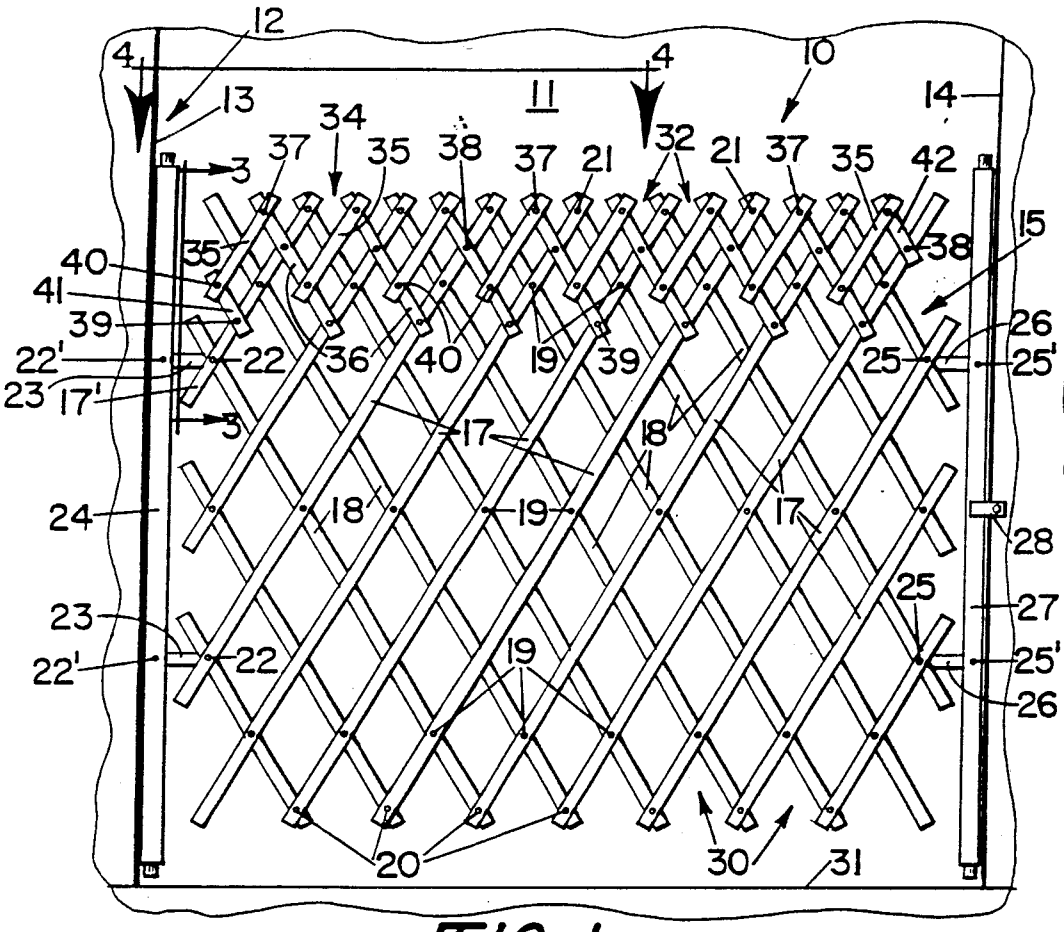
FIG. 1 is a front elevational view of the baby gate made in accordance with this invention in its expanded position closing a doorway.
Figure 4:
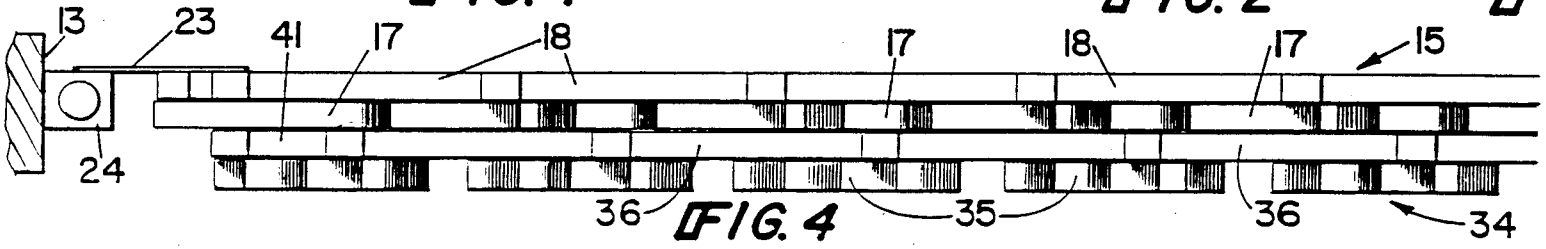
FIG. 4 is a greatly enlarged top plan section, taken along the line 4—4 of FIG. 1.

Referring now to the drawings in more detail, FIG. 1 discloses an expansible gate 10, made in accordance with this invention, mounted in an expanded position closing a doorway 11 defined by a door frame 12 including a first or left door jamb 13 and a second or right door jamb 14.

The gate 10 includes a main barrier 15 constructed of a plurality of parallel first elongated slats 17 and a plurality of parallel second elongated slats 18 intersecting the first slats 17. As disclosed in FIG. 1, the first slats 17 slant upward toward the right, while the second slats 18 slant upward toward the left. The slats 17 are generally parallel to each other in any expanded or contracted position, while the slats 18 are also parallel to each other in all positions. The first and second slats are pivotally connected together at some of the points where they intersect by the pivot pins 19. The top pivot pins 19 are disclosed in FIG. 1 as pivotally connecting the adjacent intersecting and upward divergent portions of the main slats 17 and 18 forming the V-shaped openings 30. The lower intersecting portions of the slats 17 and 18, defining the lower edge of the main barrier 15, are pivotally connected by the pins 20, while the upper intersecting portions of the slats 17 and 18, defining the upper edge portion of the main barrier 15, are pivotally connected by the pins 21. The left edge of the main barrier 15 is connected by rivets or pivot pins 22 to connector strips or slats 23 secured to a first or stationary upright post 24, such as by another set of rivets $22^1$. The stationary end post 24 may be fixed vertically flush against the first jamb 13 by any desired connector means, not shown. The right edge portion of the main barrier 15 is pivotally connected by the pins 25 to connector strips or pieces 26 secured by rivets $25^1$ to the second or movable, vertical end post 27 adapted to bear flush against the right jamb 14. The movable end post 27 may be provided with a latch member or strap 28, if desired, for securing the gate 10 in its expanded position closing the doorway 11.

The portion of the gate 10 described so far is conventional, except for the fact that the gate 10 includes an increased number of slats 17 and 18 compared with lazy-tong gates now commercially available. A conventional 3-foot expansible gate of the lazy-tong type normally has 12 wood slats, 20 rivets or pivot pins and weighs approximately 2⅔ pounds. A 3-foot expansible gate 10, made in accordance with this invention, and of the same relative overall size may include 39 slats, 79 rivets or pivot pins and weighs approximately 3½ pounds.

Because of the increased number of first and second slats 17 and 18, and further because the main barrier 15 is suspended low enough between the end posts 24 and 27, the V-shaped openings 30 in the lower edge portion of the main barrier 15 are close enough to the floor 31 that the risk of escape beneath the bottom of the gate 10 or head entrapment within the lower V-shaped openings 30 is substantially reduced or minimized. Moreover, the left ends of the slats 17 and 18, as viewed in FIG. 1, are spaced from the left end post 24 a distance which will permit the left ends of the slats to abut against the left end post 24 after the main barrier 15 has expanded to a predetermined maximum span, more than sufficient to close the door opening 11. By limiting the maximum span of the main barrier 15, the rise of the lower edges of the main barrier 15 above the floor 31 is limited to maintain the relative small size of the lower V-shaped openings 30.

However, even though the upper V-shaped openings 32 are substantially smaller because of the increased number of slats 17 and 18 located closer together, nevertheless the upper V-shaped openings 32 open upwardly into the doorway space 11 exposing the V-shaped openings to potential head or limb entrapment by a small child.

Accordingly, the gate 10 includes a supplemental barrier 34 having a lazy-tong construction. The upper supplemental barrier 34 includes a plurality of pairs of upward converging auxiliary first slats 35 and second slats 36, pivotally connected at their upper ends by the pivot pins 37. All of the first auxiliary slats 35 slant upward to the right, while all of the second auxiliary slats 36 slant upward to the left and intersect adjacent first slats 35. As best disclosed in FIG. 1, each of the second auxiliary slats 36 is longer than the first auxiliary slats 35.

Each of the second auxiliary slats 36 is pivotally connected by pins 38 and 39 to the corresponding intersecting portions of adjacent first slats 17 of the main barrier 15. The lower edge portion of each first auxiliary slat 35 is pivotally connected to the adjacent second slat 36 by a pivot pin 40, between the pivot pins 38 and 39.

The extreme left first auxiliary slat 35 is pivotally connected by a pin 40 to a foreshortened stub slat 41, which in turn is connected by a pivot pin 39 to a foreshortened main barrier slat 17[1]. The extreme right first auxiliary slat 35 is likewise pivotally connected by pin 21 to a foreshortened stub slat 42, which in turn is pivotally connected by pin 38 to an intersecting main barrier slat 17.

As disclosed in FIG. 1, all of the first auxiliary slats 35 are of equal length, are parallel to each other, and lie substantially in the same plane. Likewise, all of the second auxiliary slats 36, which are longer than the first slats 35, are of equal length and lie in a second plane parallel to the plane containing the first auxiliary slats 35.

Furthermore, all of the first auxiliary slats 35 are generally parallel, not only to each other, but also to the first slats 17 of the main barrier 15. Similiarly, all of the second auxiliary slats 36 are not only parallel to each other, but are parallel to the second slats 18. Because of the structure and arrangement of the auxiliary slats in the supplemental barrier 34, the auxiliary slats 35 and 36 move as a unit with the main slats 17 and 18, as the main barrier is expanded and contracted.

In the preferred form of the invention, the vertices or intersecting upper edge portions of the auxiliary slats 35 and 36 are generally in the same horizontal plane as the intersecting vertices of the main barrier slats 17 and 18. Moreover, the upper pivot pins 37 connecting the converging pairs of auxiliary slats 35 and 36 are generally in vertical alignment with the corresponding pivot pins 19 connecting the main slats 17 and 18 defining the corresponding V-shaped slots or openings 32. Thus, each of the pairs of auxiliary slats 35 and 36 is arranged symmetrically with the corresponding V-shaped opening 32 which the pair of auxiliary slats cover or occlude.

Each of the pairs of auxiliary slats 35 and 36, when expanded over its corresponding V-shaped opening 32 when the main barrier 15 is expanded to its closed position as disclosed in FIG. 1, substantially reduces the size of the corresponding V-shaped opening, as best disclosed in FIG. 1.

Figure 3:
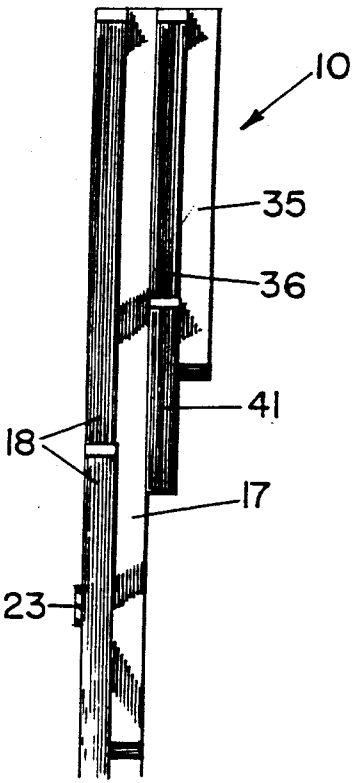
FIG. 3 is a greatly enlarged fragmentary section taken along the line 3—3 of FIG. 1.
Figure 2:
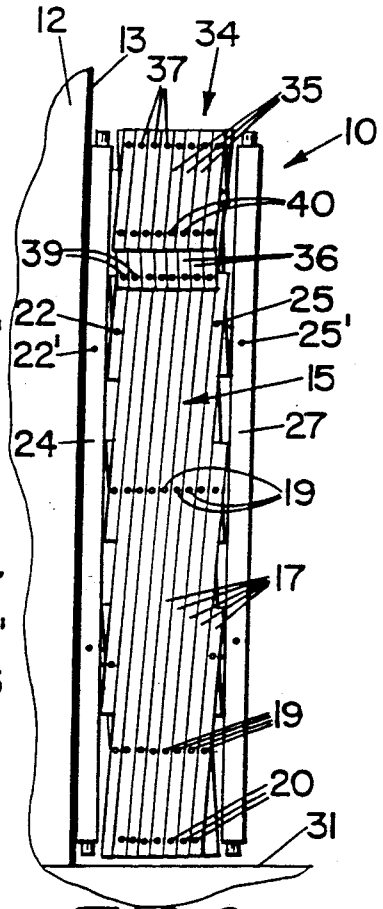
FIG. 2 is a front elevation of the gate disclosed in FIG. 1, with the gate in a contracted position to open the doorway.

FIG. 2 discloses the gate 10 in its completely contracted position opening the doorway 11. In the open position of the gate 10, the first auxiliary slats 35 abut each other, as do the second auxiliary slats 36, so that the V-shaped openings 32 are completely closed or occluded.

It is therefore apparent that an expansible gate 10 has been designed, including a main barrier 15 of the lazy-tong type supporting for unitary pivotal movement an upper supplemental lazy-tong barrier 34 which will prevent small children from entrapping their heads or limbs within the upper exposed V-shaped openings 32 formed in the upper edge portion of the main barrier 15.

The expansible gate 10 has been found to be substantially safter for use with small children than conventional gates, and particular lazy-tong type gates now commercially available.

What is claimed is:

1. An expansible gate adapted to fit within the close a doorway within a frame having opposed sides, comprising:

(a) a stationary end post adapted to be fixed to one side of a door frame, (b) a movable end post, adapted to be positioned adjacent the opposite side of the door frame in a closed position, (c) a main lazy-tong barrier suspended between said stationary and movable end posts and comprising a front portion and a top edge portion, a plurality of first elongated slats and a plurality of second elongated slats crossing and pivotally connected to said first slats, said first and second slats defining first and second parallel planes, respectively, (d) said top edge portion comprising upwardly open V-shaped openings formed between adjacent pairs of crossed first and second slats diverging upward, in said closed positions, (e) said slats terminating in overlapping upper ends in said edge portion between said V-shaped openings, (f) upper pin means pivotally connecting said overlapping upper ends, (g) a supplementary upper barrier for said V-shaped openings, comprising a plurality of pairs of first and second auxiliary slats, each pair of auxiliary slats converging upward and projecting across a corresponding V-shaped opening, (h) said first and second auxiliary slats terminating in intersecting upper ends substantially in the same horizontal plane as said upper ends of said slats of said main barrier, (i) auxiliary upper pin means pivotally connecting said intersecting upper ends of each pair of said first and second auxiliary slats, (j) means pivotally connecting a first auxiliary slat of one pair to a second auxiliary slat of an adjacent pair, for movement of said first and second auxiliary slats in planes parallel to and in front of said first and second parallel planes, and (k) means pivotally connecting an auxiliary slat of each pair to a slat in said main barrier.

2. The invention according to claim 1 in which said means pivotally connecting an auxiliary slat to a slat in said main barrier comprises a pivot pin pivotally connecting the mid-portion of a second auxiliary slat to said slat in said main barrier between the intersections of adjacent first auxiliary slats with said second auxiliary slat.

3. The invention according to claim 1 in which each of said second auxiliary slats is longer than the first auxiliary slat in said pair, and means pivotally connecting the lower end of each of said second auxiliary slats to a slat in said main barrier.

4. The invention according to claim 1 further comprising top pins pivotally connecting the intersecting portions of each pair of the upward diverging portions of said first and second slats forming V-shaped openings, said means pivotally connecting a first auxiliary slat of one pair to a second auxiliary slat of an adjacent pair comprising pivot pins which are in substantially the same horizontal plane as said top pins.

5. The invention according to claim 1 in which said first auxiliary slats are substantially equal in length and said second auxiliary slats are substantially equal in length.

6. The invention according to claim 1 in which each said pair of auxiliary slats symmetrically occludes a corresponding V-shaped opening.

7. The invention according to claim 1 in which the ends of said slats of said main barrier adjacent said stationary end post are normally spaced from said stationary end post, said ends of said slats abutting said stationary end post when said main barrier has expanded to a predetermined maximum span.

* * * * *